US006065924A

United States Patent [19]

Budd et al.

[11] Patent Number: 6,065,924

[45] Date of Patent: May 23, 2000

[54] WHEELCHAIR LIFT PLATFORM HAVING INTERNAL GAS SPRING DEPLOYMENT FROM STOWAGE POSITION

[75] Inventors: Alfred L. Budd; James R. Pierrou; Barry E. Wolff, all of Winamac; James R. Dupuy, Delphi, all of Ind.

[73] Assignee: The Braun Corporation, Winamac, Ind.

[21] Appl. No.: 09/153,136

[22] Filed: Sep. 14, 1998

Related U.S. Application Data

[60] Provisional application No. 60/093,483, Jul. 20, 1998, and provisional application No. 60/083,894, May 1, 1998.

[51] Int. Cl.[7] ..... B60P 1/44

[52] U.S. Cl. ..... 414/546; 414/917; 414/921

[58] Field of Search ..... 414/540, 546, 414/921, 917, 522, 542

[56] References Cited

U.S. PATENT DOCUMENTS

| | | | |
|---|---|---|---|
| 4,534,450 | 8/1985 | Savaria | 414/546 |
| 4,808,056 | 2/1989 | Oshima | 414/921 |
| 5,261,779 | 11/1993 | Goodrich | 414/921 |
| 5,605,431 | 2/1997 | Saucier et al. | 414/546 |
| 5,806,632 | 9/1998 | Budd et al. | 414/921 |
| 5,944,473 | 8/1999 | Saucier et al. | 414/546 |

*Primary Examiner*—Dean J. Kramer
*Assistant Examiner*—Paul J. Chin
*Attorney, Agent, or Firm*—Jacques M. Dulin; Robert F. Dennis

[57] ABSTRACT

Improvement in wheelchair lifts generally of the dual hydraulic parallelogram type employing a lever arm assembly which assists in the rotation of the platform from the stowed position to the horizontal deployed position, by providing a gas spring disposed in the lever arm assembly connected at an outboard end to the lifting mechanism link and at an inboard end to at least one of the A arm, the B arm or the common pivot pin of the lever arm assembly. The outward force of the gas spring causes the sliding shoe of the lever arm assembly to maintain contact with the outer face of the lower link of the lifting parallelogram so that upon deployment of the lift during the gravity down phase from stowed position to horizontal transfer position, the inboard end of the platform is pulled up so that it rotates smoothly and is not subjected to free fall. This lever arm follower force member can be used alone or in conjunction with a deployment assist gas spring disposed in the lifting parallelogram, alone or in combination with "reverse" type torsion springs disposed in one or more of the common pivot in the lever arm assembly or a pivot in the lifting assembly.

12 Claims, 4 Drawing Sheets

WHEELCHAIR LIFT PLATFORM HAVING INTERNAL GAS SPRING DEPLOYMENT FROM STOWAGE POSITION

CROSS REFERENCE TO RELATED APPLICATIONS

This application is related to and claims the priority under 35 U.S.C. § 119(e) of Provisional Applications Ser. No. 60/093,483 filed on Jul. 20, 1998 under the same title, and Ser. No. 60/083,894 filed May 1, 1998 entitled "Inboard Barrier Assembly For A Wheelchair Lift", the disclosures of which are hereby incorporated by reference.

DESCRIPTION

1. Technical Field

This invention relates to wheelchair lifts, and more particularly to dual hydraulic parallelogram arm lifts having a horizontally deployed platform for carrying a wheelchair and user or cargo up from an initial ground level to an intermediate transfer level from which the user or cargo may be moved into a vehicle, typically a van, bus or truck, and then by continuation of the hydraulic cylinder action cause the platform to pivot near its inboard end upwardly to a stowed position while the parallelogram closes completely. These types of lifts are mounted just inboard of a vehicle door, typically the sliding side door of a van, and the stowage motion permits the van door to be closed with the lift in the vertically stowed position interior of the van. The invention is particularly directed to the use of internal gas springs to assist in gravity down deployment of the lift platform from the over-vertical stowed position to the intermediate horizontal position at the transfer level.

2. Background

Parallelogram type wheelchair lifts are offered by a number of manufacturers, including The Braun Corporation of Winamac, Ind. in its L900 series of lifts, as shown in its U.S. Pat. No. 5,261,779, and by Ricon Corporation of Pacoima, Calif. in its S-series of lifts, as shown in U.S. Pat. No. 4,534,450 and expired U.S. Pat. Re No. 31,178. These lifts employ various mechanisms to cause the platform to move or rotate arcuately upward from the horizontal transfer level to a vertical or over-vertical stowage position.

One system for causing platform rotation involves the use of an articulated lever arm assembly comprising a pair of arms of unequal length pivotably connected to each other at one end, and pivotably connected at their other ends respectively to: a) the vertical lift arm extension of the front parallelogram link, at the bottom end of which is pivotally secured the platform, and b) the inboard end of the platform at a point inboard of the lifting arm pivot. As the hydraulic ram cylinder in the lifting assembly is actuated, lifting the platform from the ground level toward the transfer level, a sliding block, pivotally secured at the juncture of the two arms of the lever arm assembly, comes into contact with the undersurface of the bottom link of the lifting parallelogram. As the lifting of the platform continues beyond the transfer level and the lift arm approaches the bottom parallelogram link or arm, the lower long "pusher" arm of the lever arm assembly is subjected to a downward force, causing it to push on the inboard end of the platform. Like stepping on a rake, in turn this causes the platform to rotate about the pivot-point at the end of the vertical lift arm causing the outboard end of the platform to rotate upwardly to the stowed position. During this rotation, the other arm of the lever arm assembly, the shorter upper "brace" arm, serves to laterally brace the position of the slide block and thus maintains the contact of the slide block against the bottom parallelogram link as the platform is stowed.

These types of lifts also involve the use of single acting hydraulic cylinders which either pull (Braun U.S. Pat. No. 5,261,779) or push (Ricon U.S. Pat. No. Re. 31,178) to both lift and stow the platform while allowing gravity to bring the platform down from the upright stowed position by release of hydraulic pressure in the active side of the hydraulic cylinder that actuates the lifting parallelogram arms. However, the preferred position of the platform is over-vertical to secure it during vehicle motion. Accordingly, the Braun L900 series employs a gas deployment assist spring mounted in the bottom channel arm of each of the parallelograms to push the parallelograms outwardly, causing the platform to move outwardly over the vertical position to a point where gravity can take over for the further deployment of the platform When mounted inboard of a vehicle, e.g. the side or rear door of a van or bus, the stowed platform bottom (inboard end) can drift away from the stanchions on which the parallelogram arms are mounted and interfere with the opening of the vehicle door. This drift is generally parallel to the stowed position, and typically is due to loss of hydraulic fluid pressure. Other contributory causes of drift can include instances where the vehicle may not be level, where frictional forces may build up in the outboard link (lifting arm) platform pivot, or where the two parallelogram arms bind or are not synchronized, etc. The result is that the platform may move outwardly from the stowed position, but parallel thereto, rather than rotating from its lower end smoothly down to the deployed horizontal transfer level. The platform can then rotate down in a sudden arcuate movement (free fall) when the parallelogram moves far enough out and down that gravity pulls the outboard end of the platform down as well. This motion can be sudden and disconcerting to observers, particularly those outside the vehicle, albeit not ordinarily dangerous as there is no one on the platform, unless a person outside the vehicle is standing where he or she should not be, that is, in the intended and usual path of the descending lift.

One proposed solution is the use of a common stud and slot assembly, such as used in the Braun L200 series telescoping arm-type lift since circa 1978 (e.g., the whale and bearing assembly in Braun Model L211U and in Risner U.S. Pat. No. 4,474,527), or the equivalent stud and slot assembly in the sliding saddle block of Saucier Pat. No. 5,605,431 of Ricon (as shown in FIGS. 13–15 thereof). All of these releasably interlock the platform to the lifting assembly during the gravity-down phase of the platform deployment from vertical to horizontal transfer level, thus preventing platform movement in a sudden pivotal free fall. However, the Braun and Risner whale/bearing systems, while mechanically outstanding, are relatively expensive.

The equivalent saddle block stud/parallelogram slot assembly of Ricon, while cheap, is prone to wear and binding. The underarm slot/stud assembly of Ricon introduces another pair of binding points in the spaced parallelogram arms that must be kept in synchrony. This becomes increasingly difficult as the two, spaced, lifting parallelograms may not move equally during long term use cycles due to: (a) wear on hydraulic pistons or rods; (b) the build up of friction in pivots; (c) sediment or gum development in hydraulic lines; (d) torsional twisting when the vehicle is not level, (e) or torsion and twisting when the load is not centered on the platform, or the like. Accordingly, slot/stud interlocks on the bottom surface of the bottom parallelogram arms (underarm slots) are not necessarily the best or only solution to preventing occasional platform free fall.

Still another solution has been to provide torsion springs at two or more diagonally opposed pivots of the parallelogram to assist in moving the parallelogram and platform out from the over-vertical stowed position, or a torsion spring at the saddle (sliding) block pivot pin. However, such springs can weaken or break over time as they are over stressed, and are relatively difficult to replace.

DISCLOSURE OF THE INVENTION

SUMMARY, OBJECTS AND ADVANTAGES OF THE INVENTION

It is a principal object and advantage of the invention to provide a gas spring member internal to the articulated lever arm assembly to prevent free fall of the platform by keeping the slide block in contact with the bottom lifting parallelogram arm so that upon descent of the bottom parallelogram arm the platform is caused to rotate out smoothly. It is another object and advantage of the invention to provide an inexpensive system which is easy to install and maintain (even as a retrofit) to promote movement of the articulated lever arm system with the lifting parallelogram during deployment in the gravity down mode from the is vertical stowed position to the horizontal transfer position to prevent platform free fall. Other objects and advantages will be evident from the descriptions, drawings and claims of this invention.

The invention involves employing a gas spring to assist in preventing "free-fall" of the wheelchair platform as the lift is deployed from the stowed vertical position to the horizontal transfer position. This free-fall condition is apt to occur in parallelogram arm type of lifts, particularly those employing hydraulic cylinders as the lifting means. These type of lifts typically include an articulated lever system between the upper lifting parallelogram assembly and the inboard end of the platform to cause it to pivot from the horizontal transfer position to an over-vertical stowed position. The Ricon brand lift documents describe this lever assembly as a "lower parallelogram", while the Braun type lift documents describe this assembly as an "articulated lever arm assembly". The term "articulated lever arm assembly" or "lever arm assembly" is preferred because of the typically non-parallel geometry of the lever arm assembly, and to avoid confusion with the upper parallelogram assembly which lifts and supports the platform.

Both types of lifts, however, employ a system of pivoted lever arms connected to the inboard end of the platform and to the midpoint of the lifting arm for the purpose of rotating the platform to the stowed position. The lifting arm is a downward extension of the front link of the lifting parallelogram which connects the platform with the lifting parallelogram, thus supporting and lifting the platform. Both types of lifts employ a longer pusher lever arm (herein the "B arm") pivotally connected to the inboard end of the platform, typically at a point inboard of the pivot point connecting the platform with the lifting arm. This longer lever arm extends between the inboard end of the platform to a shorter upper "brace" lever arm (herein the "A arm") that bridges to the mid point of the lifting arm. The junction of the shorter A arm and the longer B arm is pivoted and carries coaxially at this pivot a slide block or saddle block which slides when brought in contact with the underside of the bottom link of the lifting parallelogram assembly.

The invention comprises providing at least one push-type gas spring which is pivotally mounted at one of its ends to the lower portion of the lifting arm at a point generally located between the lifting arm platform pivot point and the A Arm pivot point. In the preferred embodiment, the gas spring is mounted on the inside of the channel member forming the lower end of the lifting arm, as this mounting allows the gas spring to be at least partially nested within the channel as the lever arm assembly is compressed, thus resulting in a conveniently compact installation. The gas spring extends diagonally to have its other end pivotally mounted to one of: a) the A arm medial of its two ends but preferably adjacent its inner end near the slide block pivot (the preferred embodiment); b) the B arm medial of its two ends but preferably adjacent its upper end near the slide block pivot; or c) to the common pivot of the slide block with the A and B arms.

The gas spring on this invention is termed herein the "lever arm follower spring" to distinguish it from gas spring(s) used in the lifting parallelogram(s) to assist in initiating gravity down deployment from the platform stowed position, which gas springs are called herein "deployment assist springs". The gas spring employed in the invention is a compressible member (extensible force member) providing an upward return force to the lever arm assembly. This tends to close the angle between the upper (short) and rear (long) lever arms of the lever arm assembly, and tends to push the sliding block into contact against the undersurface of the bottom link or arm of the lifting parallelogram. The term "compressible member" and "extensible force member" are used herein to mean an elastically contractible member, device or assembly which, when it is caused by external forces to contract, produces a restoring force which tends to return it to an extended position. Although a number of devices exist which meet this definition, the gas spring known in the art is particularly suitable to the application of this invention.

In the descent cycle from the platform stowed position, typically there is some spring or other assist device which, when the hydraulic pressure is released to begin the descent portion of the cycle, forces the lifting parallelogram outwardly up and over the vertical position. This assist device may be another gas spring (deployment assist spring). In the Braun-type lift, this deployment assist spring spans between the inboard link (or stanchion) of the lifting parallelogram and the bottom link of the parallelogram.

Since the platform is stored in the over center position, the base moves out horizontally with the platform tilted back inboard, still over center. As this occurs, the slide block of the lever arm assembly can separate its contact from the underside of the bottom lifting parallelogram arm. Once the lifting parallelogram has moved outwardly over center, then gravity continues to bring it down because the hydraulic pressure on the cylinder has been released. As the parallelogram arm descends, the platform moves gradually from over vertical to vertical and finally slightly over vertical, at which point, if there is a separation of the slide block from the underside of the arm, the platform can pivot at its inboard end with the outboard end falling down to a horizontal position in a relatively sudden "free-fall".

Since the deployment assist spring is under compression in the platform stowed position, if the hydraulics lose pressure, it will tend to cause the platform to drift out from the over-vertical position. In the case of a stud/slot type assembly, such drift will also cause the platform to rotate, and the top (outboard end) of the platform can interfere and/or significantly mar the van door. In contrast, the articulated lever arm follower spring system of this invention counteracts platform drift from hydraulic pressure loss or drift induced when the vehicle turns left or tilts down toward the side of the vehicle in which the left is mounted (in the US to the right or rear). Accordingly, it is an important aspect of the invention to balance the two spring forces, the upward net force of the lever arm follower spring(s) against the outward force of the parallelogram arm deployment assist springs.

The lever arm follower spring of this invention pushes the upper or rear arm of the lever arm assembly upwardly so that the slide block remains in continuous contact with the bottom arm of the lifting parallelogram as the lift is deployed from the stowed position. Thus, as the parallelogram assembly moves outwardly and begins to descend, the inboard end of the platform, which is in inboard of its pivot point, is pulled upwardly by the action of the lever arm follower spring, thereby rotating the platform in a controlled continuous motion. This upward motion and consequent platform rotation is limited by the slide block contact with the underside of the bottom lifting parallelogram link or arm. Thus, the platform rotates down to the horizontal in a controlled manner coordinated with lifting parallelogram motion, and without free fall.

It is preferred to employ a deployment assist spring in conjunction with the lever arm follower spring of this invention. The force of a deployment assist gas spring may need to be adjusted to be somewhat stronger in this combination than where a lever arm follower spring is not used in connection with the lever arm assembly, because of the upward force of the slide block against the bottom lifting parallelogram arm provides additional upward resistance against deployment of the platform from the stowed position by the outward force of the deployment assist gas spring. Accordingly, it is an aspect of this invention to carefully balance the opposing forces of these two gas springs so that the gas spring provided in the lever arm assembly (lever arm follower spring) does not prevent the lifting parallelogram from coming over center outwardly during the deploy motion by use of the deployment assist gas spring.

Still further, it is a common practice to provide a torsion spring around the pivot pin of the slide block. The ends of the spring are captured in tubes, one welded to the side of the A arm of the lever arm assembly, the other to the B arm so that these arms are drawn together by the spring torsion. While it is preferred to omit this spring, as they are prone to failure, and very difficult to change in the field, it is an option of this invention to continue to employ such slide block pivot pin torsion springs in combination with the lever arm follower spring provided internal to the lever arm assembly as described herein. Accordingly, it is another aspect of this invention to provide a balancing of all three springs, the two gas springs, ie., the lever arm follower spring and the deployment assist spring (compressible members), and the pivot pin torsion spring.

As an alternative or in addition to the use of the gas spring in the upper parallelogram arm assembly, tension springs may be used at one or more of the pivots of the lifting parallelogram arm to assist in the deploy portion of the cycle to provide the force to move the lifting parallelogram from over center outwardly when the hydraulic pressure is released. Accordingly, it is another aspect of this invention to provide a balancing of all of these forces in combination in their various alternatives: the torsion springs in one or more of the pivots of the lifting parallelogram, the deployment assist spring in the lifting parallelogram, the torsion spring(s), the diagonal springs in the lever arm assembly of our co-pending application Ser. No. 08/843,497 filed Apr. 16, 1997, and the gas spring in the lever arm assembly.

U.S. Pat. No. 5,605,431 issued Feb. 25, 1997 shows the use of a stud mounted on the slide block to interlock with a keyhole slot on the lower side of the bottom parallelogram arm. That system can experience binding, particularly where the hydraulic cylinders, one mounted in each of the two spaced upper lifting parallelogram arm assembly are not in synchrony or other binding occurs in the pivots of those assemblies such that the two arms do not descend simultaneously or equally. In addition, binding can occur should the platform or lifting arms become warped during operation, or the load is not centered on the platform. In contrast, this invention, In having a slide block which is free floating without interlock with the lifting parallelogram arm, is a distinct advantage and step forward in the art because it avoids a potentially serious point of binding during the descent portion of the cycle from the storage position to the deployed transfer position.

It should be noted that a lever arm follower spring can be used in conjunction with each of the two lever arms, and likewise the deployment assist springs can be paired, one in each parallelogram. In the latter case, where the parallelogram is a Ricon type (diagonally, from upper outboard link pivot to inboard lower stanchion pivot) the deploy assist device is reversed (a pull type) and is located above the hydraulic lifting cylinder, and may be something as simple as a tension spring.

DETAILED DESCRIPTION OF THE BEST MODE OF THE INVENTION

The following detailed description illustrates the invention by way of example, not by way of limitation of the principles of the invention. This description will clearly enable one skilled in the art to make and use the invention, and describes several embodiments, adaptations, variations, alternatives and uses of the invention, including what is presently believed to be the best mode of carrying out the invention.

In this regard, the invention is illustrated in the several figures, and is of sufficient complexity that the many parts, interrelationships, and sub-combinations thereof simply cannot be fully illustrated in a single patent-type drawing. For clarity and cones, several of the drawings show in schematic, or omit, parts that are not essential in that drawing to a description of a particular feature, aspect or principle of the invention being disclosed Thus, the best mode embodiment of one feature may be shown in one drawing, and the best mode of another feature will be called out in another drawing.

Figure 1:
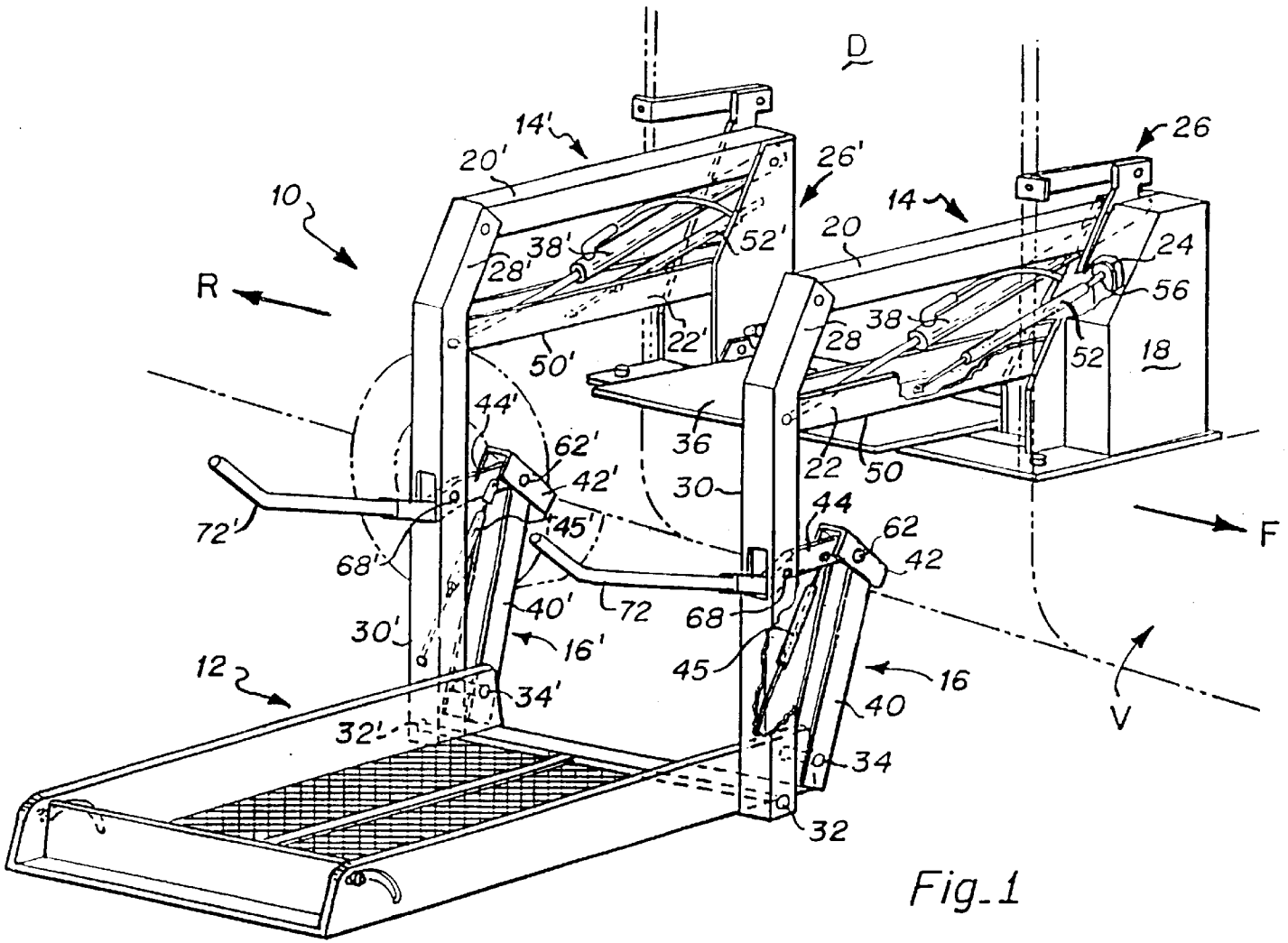
FIG. 1 is an isometric view of a typical Braun-type parallelogram lift where the hydraulic cylinder is the pull (retracting) type and is mounted diagonally down across the parallelogram, the lift being shown in the platform-on-ground position, and illustrates the articulated lever arm system of this invention in which the lever arm follower spring bridges between the vertical lifting arm and the shorter upper lever arm (A arm) at a point near the slide block.

FIG. 1 shows a Braun-type parallelogram lift 10, viewed from the exterior of the is vehicle, comprising platform assembly 12, paired parallelogram arm lifting assemblies 14, 14', articulated lever assemblies 16, 16' and hydraulic pump/control assembly 18 as mounted in vehicle V, for example in a side door opening, D. The front and rear of the vehicle are indicated by F and R respectively. The lift assembly parallelogram comprises top links 20, 20' bottom links 22, 22' rear links 24, 24' (located, but not visible, in or as part of the stanchions 26, 26'), and the front links 28, 28'. The front link lower extensions 30, 30' are the lifting arms to which the platform assembly 12 is pivoted at 32, 32' adjacent the inboard end, but outboard thereof a distance sufficient to provide a lever arm by the spacing between pivot 32,32' and the articulated lever arm B lower pivot 34,34'. The bridge plate is 36, and the lifting hydraulic cylinders are 38, 38' The bridge plate may be mounted on the inboard end of the platform 12.

The articulated lever arm assembly 16,16' comprises the lower, longer lever arm 40, 40', (arm B) the pivoting slide block (saddle block) 42, 42', and the short upper lever arm 44, 44' (arm A). The lift is shown at the ground level with the slide blocks 42,42' disengaged from sliding contact with the underside 50, 50' of the bottom lifting parallelogram arm 22, 22' (bottom link). The gas deployment assist spring 52 is secured at the outer, rod end to the inside of the bottom lifting parallelogram arm 22 and at the inner, cylinder end 56 to the rear link 24. Portions of the bottom arm and stanchion cover are broken away to show the ends and securement points.

In addition to showing the general features of a Braun-type parallelogram lift, FIG. 1 shows the preferred embodiment of the lever arm follower of this invention which comprises one gas spring 45, 45' for each of the lever arm assemblies. The gas spring bridges between the lower portion of the lifting arm 30, 30' at a point near the platform pivot 32, 32' and the upper A arm 44, 44' at a point near the slide block pivot 62, 62'. The lever arm follower springs 45, 45' force the two lever arms together, thereby causing the slide block 42, 42' to move upward and inboard. In the Ricon stud/slot assembly, a reverse or compressive type torsion spring (not shown) is used at each of the pivots 62, 62' to force the two arms of the articulated lever assembly together. The gas spring of the present invention may be used with or without such torsional pivot pin springs, but preferably without, to eliminate torsional spring failure.

Figure 2A:
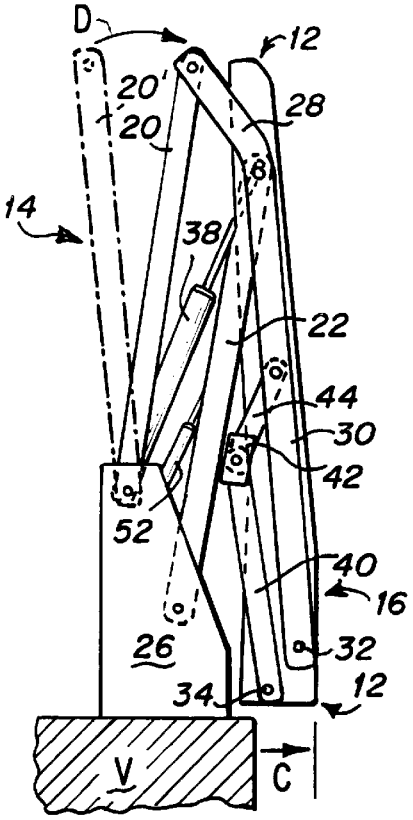
Fig.2A (PRIOR ART)
FIGS. 2A and 2B are side elevations of a typical prior art parallelogram lift showing a simplified view of the parallelogram assembly, lever arm assembly, and platform assembly in two sequential positions during platform deployment, and illustrating the "free fair" action during deployment and its relation to the lever arm assembly motion.
Figure 2B:
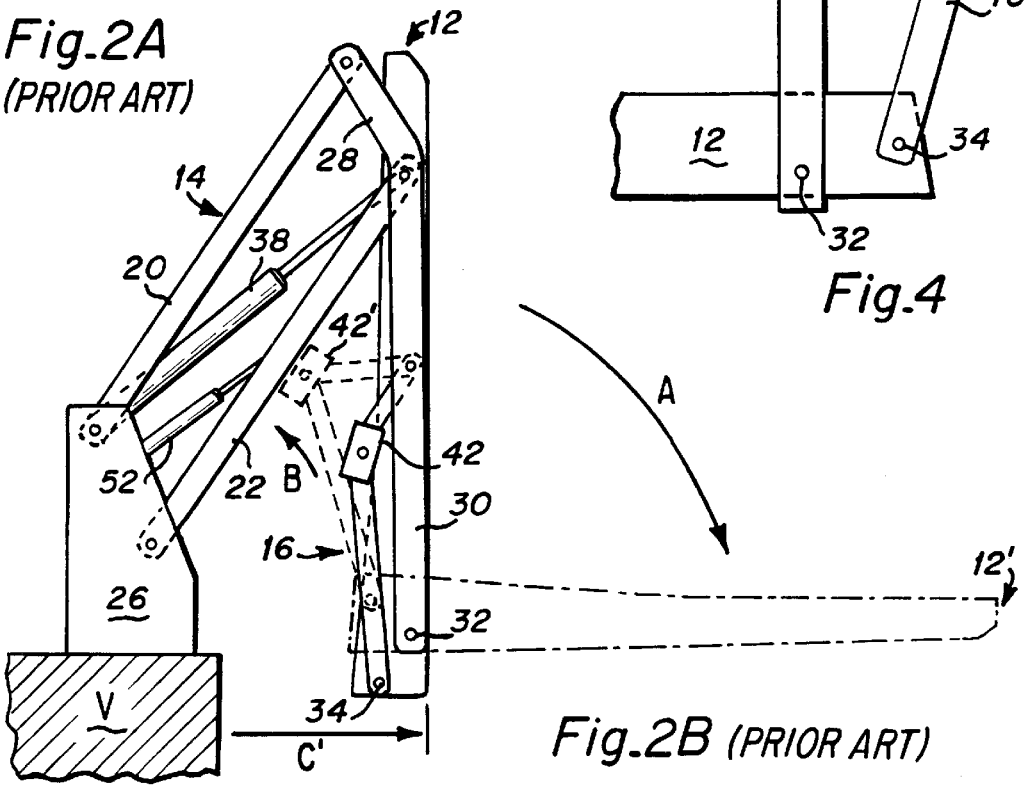
Fig.2B (PRIOR ART)

FIGS. 2A and 2B are side elevations of a parallelogram lift showing a simplified view of the parallelogram assembly 14, lever arm assembly 16, and platform assembly 12 in two sequential positions during platform deployment, and illustrating the "free fall" action during deployment and its relation to the lever arm assembly motion when the lever arm assembly does not have a lever arm follower spring (45 in FIG. 1) or equivalent. For purposes of clarity of illustration, these figures do not show the bridge plate, the hand rails, or the hydraulic assembly (36, 72 and 18, respectively in FIG. 1) nor do they show details of the platform assembly. As shown also in FIG. 1, the lifting parallelogram assembly 14 comprises a top link 20, a bottom link 22, a stanchion 26, a front link 28, a lifting cylinder 38, and a deployment assist spring 52. The front link 28 has a lift arm extension 30 which is pivotally connected 32 at its end to the plathe medial portion of the lift arm 30 to the slide block 42, and the lower B arm 40 extending from a pivotal mounting on the inboard end of the platform assembly 12 to the slide block 42, the mutual coaxial junction of the A arm, the B arm and the slide block being a pivot. Unlike FIG. 1, no lever arm follower spring is present.

FIG. 2A shows a lift which has just begun to deploy from the platform stowed position (20' in phantom) to position shown by arrow D by the action of the deployment assist spring 52 following release of hydraulic pressure from cylinder 38, and in which the inboard portion of the platform assembly 12 has moved a short distance outward from the vehicle V as shown by Arrow C. The platform assembly 12 remains in an over-vertical position and the slide block 42 has just broken contact with the bottom parallelogram link 22.

FIG. 2*b* shows the lift of FIG. 2A in time sequence as deployment continues upon further release of hydraulic fluid from cylinder 38 and the platform assembly 12 has moved a further distance outward from the vehicle V as shown by Arrow C'. The platform assembly 12 initially remains in an essentially vertical position since the sum of its weight and inertial forces balances nearly above the pivotal junction 34 of the platform assembly 12 and the lift arm 30. In the absence of a lever arm follower spring or the equivalent, there are no substantial forces tending to produce prompt and coordinated rotation of the platform or tending to produce articulated motion of the lever arm assembly 16. Thus the slide block 42 continues to widen its separation from the bottom parallelogram link 22, and the lower (inner) end of the platform moves out laterally.

FIG. 2*b* represents a statically unstable system, because as soon as the line of action of the sum of the weight and any inertial or dynamic forces on the platform assembly 12 moves slightly outboard of the platform pivotal junction 34, the platform 12 is free to rotationally accelerate rapidly under gravitational forces without restraint other than the minimal frictional forces in the various pivots of the lever arm assembly 16. This starting point of platform free fall is unpredictable because it is influenced by vehicle tilt, vehicle passenger motion, or any external force, such as wind gusts, which contributes to the sum of forces on the unstably balanced platform. This unrestrained acceleration or "free fall" of the platform 12 continues as shown by Arrow A until the articulated motion of the lever arm assembly 16 acting on the slide block 42 moves the block as shown by Arrow to rest at transfer position 12' (dashed outline).

From the illustration in FIGS. 2A and 2B of the free fall phenomenon, it can be seen that any device, such as a lever arm follower spring, which prevents the slide block from separating from the bottom parallelogram link as lift deployment is initiated will, by causing immediate articulated motion of the lever arm assembly, cause the platform to begin rotation immediately as the parallelogram assembly begins to unfold. Platform rotation then proceeds smoothly without free fall at a rate controlled by the rate of parallelogram motion, which is controlled in turn by the selected rate of hydraulic fluid release from the cylinder.

Figure 3:
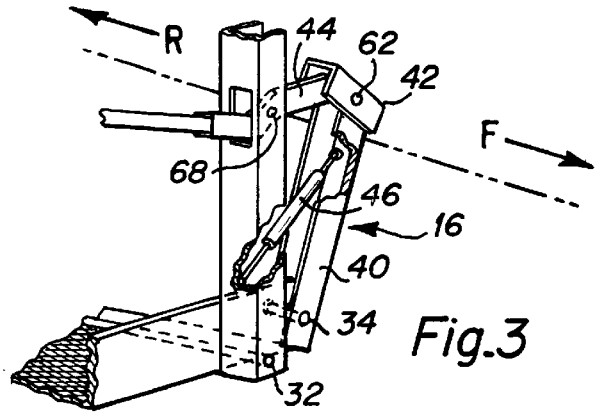
FIG. 3 is an isometric view of a portion of a Braun-type parallelogram lift showing the lever arm assembly in generally the same configuration as FIG. 1, which illustrates an alternative embodiment of the articulated lever arm system in which the lever arm follower spring bridges between the vertical lifting arm and the longer pusher lever arm (B arm) at a point near the slide block.

FIG. 3 shows a portion of a parallelogram lift, and in particular the articulated lever arm assembly 16, in generally the same configuration as is shown in FIG. 1, but illustrating an alternative embodiment of the invention. In this embodiment the lever arm follower spring 46 bridges between the lower portion of the lifting arm 30 at a point near the platform pivot 32 and the lower pusher arm (B arm) 40 at a point near the slide block pivot 62.

Figure 4:
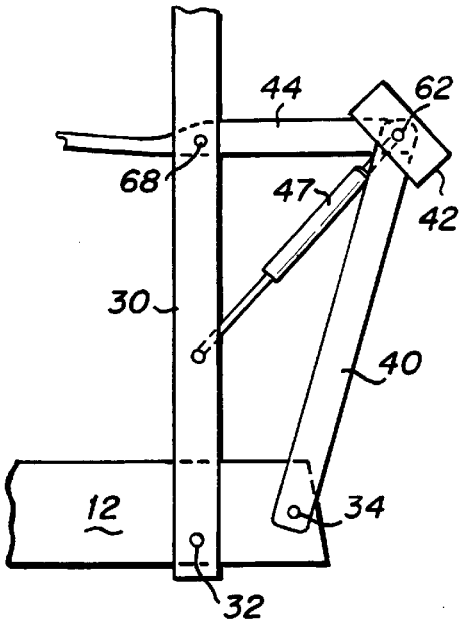
FIG. 4 is a side elevation of a portion of a Braun-type parallelogram lift showing the lever arm assembly, which illustrates a third alternative embodiment of the articulated lever arm system in which the lever arm follower spring bridges between the vertical lifting arm and the slide block pivot.

FIG. 4 is a side elevation of a portion of a Braun-type parallelogram lift showing the lever arm assembly, which illustrates an alternative embodiment of the articulated lever arm system in which the lever arm follower spring 47 bridges between the vertical lifting arm 30 and the slide block 42, the spring being mounted coaxially with the slide block pivot 62, which is also the pivot connection for the two lever arms 40 and 44.

Figure 5A:
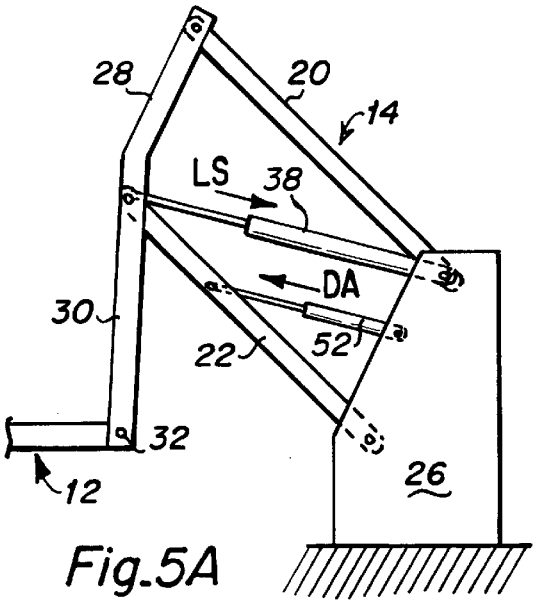
FIG. 5A is a side elevation of a portion of a Braun-type parallelogram lift showing the lifting parallelogram with its associated pull-type lifting cylinder and deployment assist spring.
Figure 5B:
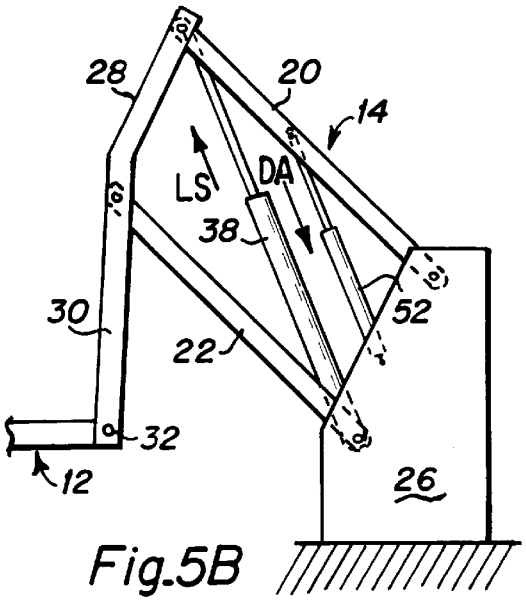
FIG. 5B is a side elevation of a portion of a Ricon-type parallelogram lift showing the lifting parallelogram with its associated push-type lifting cylinder and a deployment assist spring in accord with this invention.

FIGS. 5A and 5B are side elevations of a portion of one side of a Braun-type parallelogram lift and a Ricon-type parallelogram lift respectively in simplified form is showing the alternative lifting cylinder and deployment assist geometries. In both figures the lifting parallelogram 14 is defined by a top link 20, a bottom link 22, each of which is pivoted to a front link 28 and the stanchion assembly 26. The lifting arm 30 is shown connecting to the platform 12, but the lever arm assembly is omitted from the view for simplicity.

FIG. 5A shows a Braun pull-to-lift (retract) type parallelogram assembly in which the lifting cylinder 38 is mounted at one end adjacent the junction of the bottom link 22 and the front link 28 and spans to the inboard pivot of top link 20 on the stanchion assembly 26. Arrow LS shows the direction of lifting cylinder action applied to lift and stow the platform, in which the cylinder retracts from an extended state. The deployment assist spring 52 spans from the stanchion assembly 26 to a point on the bottom link 22. Arrow DA shows the direction of action applied by the deployment assist spring to urge the deployment of the parallelogram outwardly from the stowed position, in which the gas spring extends from a compressed state.

FIG. 5B shows a Ricon push-to-lift (extend) type parallelogram assembly in which the lifting cylinder 38' is mounted at one end adjacent the junction of the top link 20 and the front link 28 and spans to inboard pivot of lower link 22 on the stanchion assembly 26. Arrow LS shows the direction of lifting cylinder action applied to lift and stow the platform, in which the cylinder extends from a retracted state. The deployment assist spring 52' spans from the stanchion assembly 26 to a point on the top link 20. Arrow DA shows the direction of action applied by the deployment assist spring to urge the deployment of the parallelogram from the stowed position, in which the spring retracts under tension from an extended state.

Figure 6A:
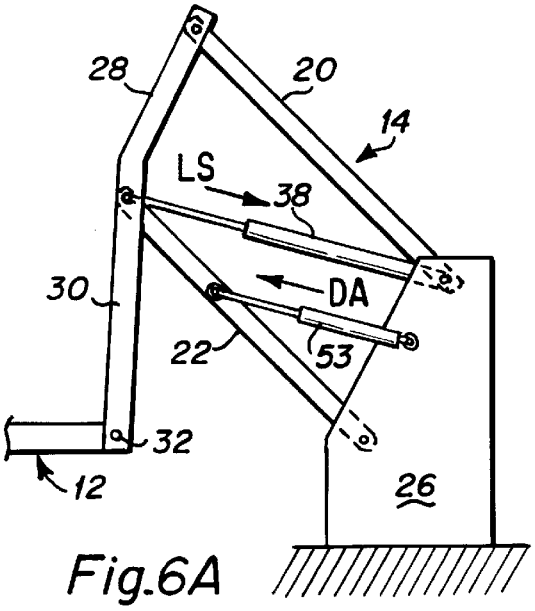
FIG. 6A is a side elevation of a portion of a Braun-type parallelogram lift showing an alternative embodiment of the lifting parallelogram in which the deployment assist spring is mounted externally to the parallelogram structure.
Figure 6B:
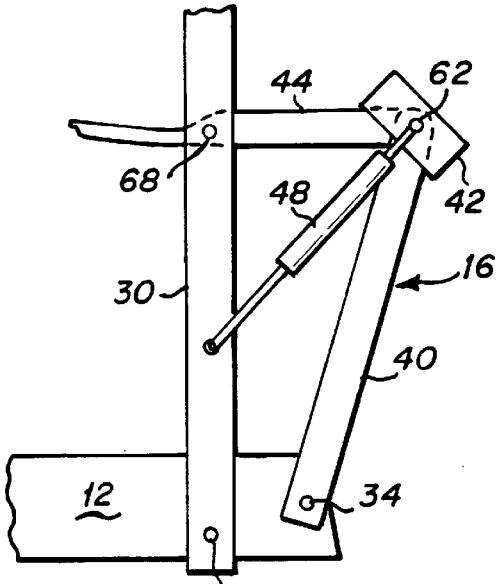
FIG. 6B is a side elevation of a portion of a Braun-type parallelogram lift showing the lever arm assembly, which illustrates an alternative embodiment of the articulated lever arm system in which the lever arm follower spring is mounted externally to the lever arm assembly structure.

FIGS. 6A and 6B illustrate alternative embodiments of the deployment assist spring and the lever arm follower spring respectively in which these components are externally mounted.

FIG. 6A is a side elevation of a portion of a Braun-type parallelogram lift showing the deployment assist spring mounted externally to the lifting parallelogram structure. The lifting parallelogram 14 is the same as depicted in FIG. 5A, except that the deployment assist spring 53 does not lie within the plane of the parallelogram and does not nest within the bottom link channel 22 in the stowed position, but instead is mounted in a laterally offset, external position. The deployment assist action is equivalent, but the external location provides a design option, particularly if structural clearance limitations in the stowed position make an internally mounted spring inconvenient, or where ease of change-out or repair is a decisive consideration.

FIG. 6B is a side elevation of a portion of a Braun-type parallelogram lift showing the lever arm assembly 14, showing the lever arm follower spring 48 mounted externally to the articulated lever arm system structure. The articulated lever arm system structure is the same as depicted in FIG. 4, except that the lever arm follower spring 48 does not lie within the plane of the articulated lever arm system and does not nest within the lifting arm channel 30 or the lower pusher arm channel (B arm) 40 in the stowed position, but instead is mounted in a laterally offset external position. The lever arm following effect is equivalent, but the external location provides a design option, particularly if structural clearance limitations in the stowed position make an internally mounted spring inconvenient, or where ease of change-out or repair is a deciding consideration.

Figure 7:
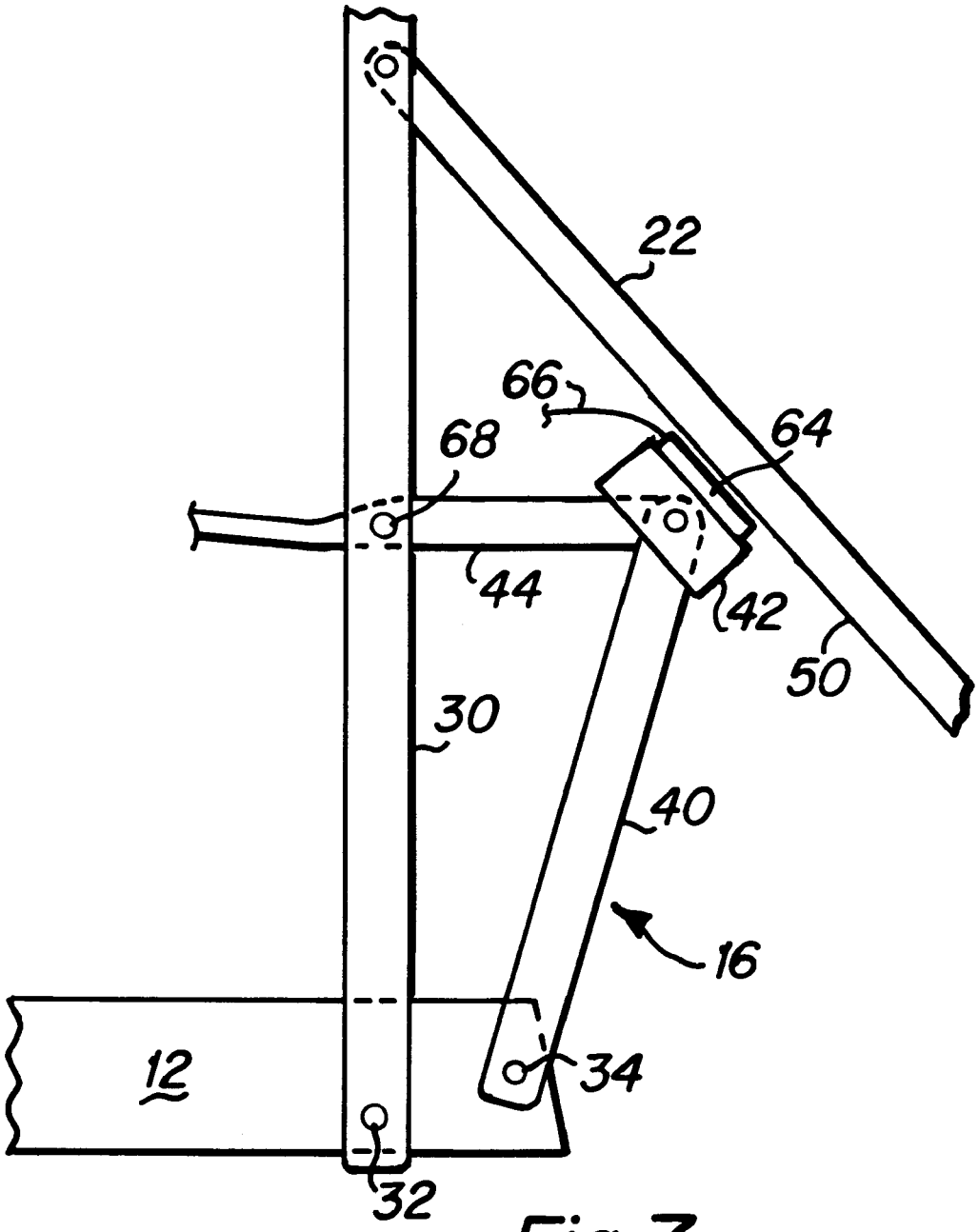
FIG. 7 is a side elevation of a portion of a Braun-type parallelogram lift showing the lever arm assembly, which illustrates an alternative embodiment of the articulated lever arm system in which an electromagnet assembly is substituted for the lever arm follower spring.

FIG. 7 is a side elevation of a portion of a Braun-type parallelogram lift showing the lever arm assembly, which illustrates an alternative embodiment of the articulated lever arm system in which an electromagnet assembly is substituted for the lever arm follower spring. The articulated lever arm system structure is the same as depicted in FIG. 4, except that the lever arm follower spring 45 is omitted and a electromagnet assembly 64 is mounted on the slide block 42. As the lift moves towards the stowed position the slide block and magnet assembly approaches the underside 50 of bottom link 22, and the surface of the electromagnet assembly makes sliding contact with the bottom link. In this embodiment either the primary structure of the bottom link 22 is of a ferromagnetic material such as steel, or a surface plate of ferromagnetic material may be mounted on the bottom surface 50. The electromagnet assembly 64 is activated by current applied through actuator cable 66, and may be controlled by a suitable position switch known in the art. The attractive force applied by the magnet serves to keep the slide block 42 in contact with the bottom link 22 as deployment begins, preventing "free fall". The magnet force may be balanced with tie deployment assist spring force in the same fashion as is described above with respect to the balancing of the lever arm follower spring force.

The electromagnetic activation can be keyed to platform position and/or lifting parallelogram position, e.g. by having a cam or trip-finger(s)on an inboard end of the lower arm to trip "on" or/and "off" electromagnet energizing switches positioned so that if the platform drifts out from the stowed position, the electromagnet is energized to maintain lever arm contact with the lower arm of the lifting parallelogram. The electromagnet is tripped off when the platform descends to between about 45° to 30° above horizontal so the lever arm can normally disengage from the parallelogram link.

Industrial Applicability

It is evident that the gas spring lever arm follower spring system of this invention will have immediate applicability in the wheel chair lift industry as it provides a simple, inexpensive, easy to replace, repair and retrofit solution to platform free fall, without introducing the problems of pivot pin torsion spring failure/fatigue or stud/slot binding and wear problems, while providing better deployment control. The follower spring system may also be used in combination with the lifting parallelogram deployment assist spring (preferable), or a stud/slot assembly (optional), or the slide block or parallelogram pivot reverse torsional spring(s).

It should be understood that various modifications within the scope of this invention can be made by one of ordinary skill in the art without departing from the spirit thereof. For example, the lifting parallelogram deployment assist spring and the lever arm follower spring system of this invention can be applied to a side whale and bearing assembly, to lifts of types other than dual parallelogram lifts, and the like. One very easy application to chain drive parallelogram lifts of the Ricon S1000 type, and to tailgate lifts. Either the deployment assist spring or the lever arm follower spring can be external to the lifting parallelogram or the lever arm assembly, as for example in the case of the Ricon-type lift where the lifting ram orientation is reversed, which reversal does not provide internal clearance for the gas spring. The lever arm follower spring system can be substituted with hydraulic cylinders, reverse gas springs (tension rather than compression type), chain or cable drive linkages, or the like. Likewise the deployment assist spring system can be substituted with a hydraulic or pneumatic cylinder or a linear actuator if it is desired to be an active element rather than a stored energy element. While the platform stowage assembly is herein termed a lever arm system, it may also be called a second, smaller parallelogram system to distinguish it from the lifting parallelogram assemblies. Further, a regular magnet in place of or addition to an electromagnet may be used. We therefore wish this invention to be defined by the scope of the appended claims in view of the specification as broadly as the prior art will permit.

What is claimed is:

1. In a wheelchair lift assembly comprising a platform assembly, a lifting assembly having a link from which said platform is pivotally connected, and a lever arm assembly for causing said platform to rotate from a horizontal transfer position to a generally vertically stowed position, said lever arm assembly comprising a first, upper short A arm pivotally secured to said link at a first end, a second, longer lower B arm pivotally secured at one end of to said platform inboard of the pivotal connection between said link and said platform assembly, said A and said B arm being connected at their opposite ends in a common pivotal connection and carrying thereat a sliding block pivotally journaled at said common pivot of said A arm and said B arm, the improvement which comprises:

an extensible force member having a first lower end pivotally secured to said link between said A arm connection point and said link-to-platform connection, and an opposite end connected to at least one of said A arm, said B arm or said common pin to which said A arm and said B arm are pivotally journaled, so that said lever arm assembly is urged upwardly to promote rotation of said platform from its vertical stowed position to said horizontal position upon deployment of said lifting assembly from a stowed to a deployed position thereby assisting in eliminating freefall of said platform which arises from separation of said lever arm assembly from said lifting assembly.

2. An improved wheelchair lift assembly as in claim 1 wherein said lifting assembly is a parallelogram type lifting assembly.

3. An improved wheelchair lift assembly as in claim 2 wherein said lever arm assembly includes at least one channel member and said extensible member is disposed with at least a portion thereof in said channel member.

4. An improved wheelchair lift assembly as in claim 2 wherein said second end of said gas spring is pivotally connected to said A arm.

5. An improved wheelchair lift assembly as in claim 2 wherein said extensible member is disposed externally of at least one of said link and said lever arm assembly arms.

6. An improved wheelchair lift assembly as in claim 1 wherein said lever arm assembly includes at least one channel member and said extensible member is disposed with at least a portion thereof in said channel member.

7. An improved wheelchair lift assembly as in claim 1 wherein said extensible member is a gas spring.

8. An improved wheelchair lift assembly as in claim 7 wherein said second end of said gas spring is pivotally connected to said A arm.

9. An improved wheelchair lift assembly as in claim 1 which includes a deployment assist force member.

10. An improved wheelchair lift assembly as in claim 9 wherein said deployment assists member is a gas spring.

11. An improved wheelchair lift assembly as in claim 10 wherein said lifting assembly is a parallelogram type lift and said gas spring is journaled at an inboard end to a rear link of said parallelogram, and at an outboard end to a bottom link wherein the parallelogram lifting power source is a pull-type hydraulic cylinder, and to an upper link wherein said parallelogram lifting power source is a push-type hydraulic cylinder.

12. An improved wheelchair lift assembly as in claim 10 which includes a compression type pivot pin coil spring which is disposed in at least one of the common pivot in said lever arm assembly or said lifting assembly.

* * * * *